United States Patent [19]

Lovret

[11] 4,230,086

[45] Oct. 28, 1980

[54] FUEL DRIP PRIMING SYSTEM FOR COLD INTERNAL COMBUSTION ENGINES

[76] Inventor: John E. Lovret, 145-20 243rd St., Rosedale, N.Y. 11422

[21] Appl. No.: 2,376

[22] Filed: Jan. 10, 1979

[51] Int. Cl.[3] ..... F02M 1/16

[52] U.S. Cl. ..... 123/187.5 R; 123/179 L; 123/468; 251/324

[58] Field of Search ..... 123/187.5 R, 179 G, 123/180 R, 139 BF, 179 L; 251/324, 321, 284

[56] References Cited

U.S. PATENT DOCUMENTS

| | | | |
|---|---|---|---|
| 1,488,981 | 4/1924 | Frentsos | 251/324 |
| 2,040,945 | 5/1936 | Leuschner | 123/187.5 R |
| 2,756,740 | 7/1956 | Deane | 251/321 |
| 3,371,657 | 3/1968 | Buchser | 123/187.5 R |
| 3,614,945 | 10/1971 | Schlagmüller et al. | 123/187.5 R |
| 3,656,464 | 4/1972 | Hilborn | 123/139 BF |
| 3,788,251 | 1/1974 | Haak | 251/321 |

*Primary Examiner*—Charles J. Myhre
*Assistant Examiner*—Andrew M. Dolinar
*Attorney, Agent, or Firm*—Nicholas J. Garofalo

[57] ABSTRACT

A system for fuel drip priming an internal gasoline combustion engine of a motor vehicle so as to enable it to subsequently start up quickly after it has become cold from being parked in cold weather for several hours or overnight, in which system the fuel pump is connected through a selectively operable control valve unit with drip nozzle units mounted in the intake manifold near the intake ports of the engine, whereby in addition to the benefits of quick starting of the engine there is also obtained the resultant benefit of fuel saving.

5 Claims, 6 Drawing Figures

FUEL DRIP PRIMING SYSTEM FOR COLD INTERNAL COMBUSTION ENGINES

BACKGROUND OF THE INVENTION

This invention is directed to improvements in fuel priming systems for effecting quick starting of a cold internal combustion engine of a motor vehicle. More particularly, it is directed to providing a system utilizing a principle of drip priming for this purpose.

I have found that by drip priming an internal combustion engine of a motor vehicle, the engine, after being parked for several hours or overnight, can be caused to start up immediately upon turning the ignition key.

Apparatus of this nature is very much in need, particularly at the present time, because of the growing shortage of fuel supplies and because of the corresponding increase in the cost thereof.

SUMMARY OF THE INVENTION

Accordingly, the present invention is directed to providing an efficient, practical and inexpensive system for drip priming an internal combustion engine of a motor vehicle so as to cause fast starting of the engine when cold.

In this improved system I provide means that is operable at the election of and under the control of the operator, whereby fuel is caused to be pumped through a control valve unit and connecting lines to nozzles opening into the intake manifold near the intake ports to the piston cylinders of the engine. The nozzles are such that fuel is caused to slowly drip from fuel lines into the intake manifold where it quickly vaporizes, so that hours later the engine, though cold, will start instantly upon turning the ignition key to crank the engine.

In this system there is also provided impedance means for causing interference with the fuel-air mixture normally passing from the carburetor through the intake manifold to the piston cylinders. The impedance creates turbulance in the fuel mixture enabling it to more completely vaporize and thus provide a better fuel-air combustible mixture than would otherwise occur. This impedance action accordingly tends to better insure running of the cold engine without stalling after it has been started, thus effecting a further saving in fuel.

Accordingly, by means of this improved system there is a saving in fuel not only in obtaining quick starting of a cold engine, but also in providing a more combustible condition in the fuel normally passing from the carburetor to the engine.

Further, the system utilizes components of simple structure made from stock material; and the system is organized in the arrangement of its components between the fuel pump of the engine and the intake manifold without affecting the normal feeding of fuel from the carburetor to the engine.

A feature of each nozzle in the system is in its association with an individual holder in which it is fitted. This enables the nozzle and its orifice to be reduced in length to a minimum, thus making the axial disposition and straightness of the restricted orifice in the nozzle a simple matter to manufacture. The nature of the nozzle in relation to its holder is such as to provide a slow dripping of fuel from the connected fuel line into the engine's manifold. The holder is designed to depend partway into the intake manifold in the path of fuel flowing from the carburetor to the engine so as to develop turbulance in the fuel. A locknut unitary with the holder serves to determine and fix the position of the holder and the nozzle in the manifold.

A feature of the fuel control valve unit lies not only in its inexpensive simple structure, but also in the nature of its inlet and outlet ports as well as in the nature of a valve element which is slidable to open and closed positions relative to these ports. The valve is a simple cylindrical pin or rod of stock material which is slidable in the valve unit to carry a neck in its body into or out of register with the inlet and outlet ports. Accordingly, the valve may be readily slipped free of the unit for replacement or cleaning. Further, the nature of the valve unit is such that either of its ports may, at the election of the user serve equally as well as the inlet or outlet.

Another feature lies in a mounting bracket for the valve unit, which bracket is readily attachable to a suitable support in the engine compartment of the vehicle and provides a clamp in which the valve unit is releasably held in place.

The foregoing as well as other features, advantages and the beneficial characteristics of the present invention will become apparent as this description proceeds in further detail.

DESCRIPTION OF A PREFERRED EMBODIMENT

Figures 1, 2, 3, 4, 5, 6:
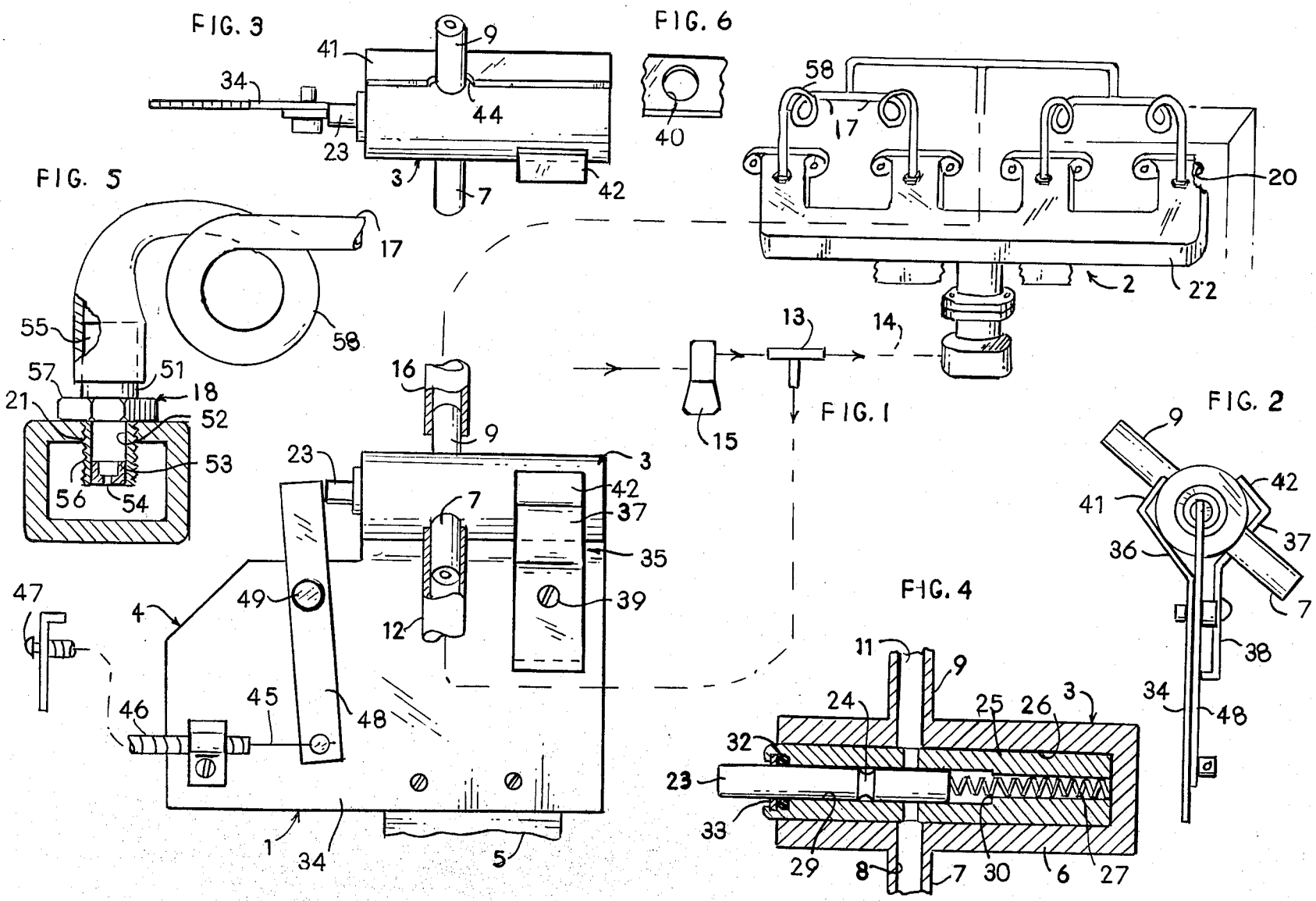
FIG. 1 is a view of a fuel drip priming system illustrating an embodiment of my invention in association with a gasoline powered internal combustion engine of a motor vehicle.
FIG. 2 is a detail veiw in front end elevation of the valve unit and its mounting bracket.
FIG. 3 is a top plan view of FIG. 2.
FIG. 4 is an enlarged longitudinal sectional view of the valve unit apart from its mounting bracket.
FIG. 5 is a detail view showing the association of one of the nozzle units with the intake manifold of the engine.
FIG. 6 is a fragmentary detail showing the extension tab of the mounting bracket modified so as to have a hole therein in lieu of the cutaway in its edge shown in FIG. 3.

The invention will now be described with reference to the accompanying drawing sufficiently and in such concise manner as to enable persons having ordinary skill in this art to understand and use the invention.

The system shown in the accompanying drawing as illustrating an embodiment of the invention comprises an organized group of interconnected components, generally designated 1, integrated with an internal gasoline combustion engine 2 of a motor vehicle.

The system includes a fuel priming control valve unit 3 mounted in a supporting bracket 4. The bracket is attached to a suitable support 5 in the engine compartment of the vehicle. The valve unit has a cylindrical body 6 from which radially extend an inlet tube 7 defining an inlet port 8, and an outlet tube 9 defining an outlet port 11.

The inlet tube 7 is connected by a hose 12 with one outlet of a T-fitting 13. A second outlet of the T-fitting is connected to the float chamber 14 of the engine's carburetor; and an inlet to the T-fitting is connected to the discharge outlet of the engine's fuel pump 15.

The outlet tube 9 of the valve unit connects with a hose 16 having multiple branches 17. Each of the latter connects with a separate nozzle unit 18. Each nozzle unit is threadedly engaged in a hole 21 formed in the upper wall of a branch of the intake manifold 22. Hole 21 is located near the engine block and in close relation to an intake port 20 of a piston cylinder.

The inlet port 8 to the valve unit is designed to be opened or closed to the outlet port 11 by means of a valve 23. The valve is a cylindrical pin or rod which has been cut from stock material and provided with a neck or annular groove 24 intermediately of its ends. The valve has a slide fit in a bushing 25, which bushing is seated in an axial bore 26 formed in the body of the valve unit. The bushing has a pair of cross-holes which are aligned with the inlet and outlet ports 8 and 11. The valve 23 is slidable in the bushing to carry its neck 24 into or out of register with the inlet and outlet ports.

The valve has a closed normal position, as in FIG. 4 in which position its inner end abuts against a return spring 27, and its body closes over and blocks the inlet port from the outlet port. The valve has an operated or open position in which its neck 24 registers with and communicates the inlet port with the outlet port.

The return spring 27 is seated in a counterbore 28 formed in the inner portion of the bushing. The counterbore is of a lesser diameter than the main bore 29 of the bushing, whereby an annular shoulder 30 is defined at the junction of the two bores. The shoulder serves as a stop that prevents the valve from over-riding the inlet and outlet ports 8 and 11 when being moved to its open position. It also serves to insure a precise open condition for the valve.

An annular recess is provided in the outer end of the bushing, in which recess an o-ring seal 32 is seated about the valve. A washer 33 fronts the o-ring seal; and the terminal end of the bushing is peened over upon the washer to retain the latter and the o-ring seal in place.

The bracket 4 in which the valve unit 3 is supported has a mounting plate 34 as its body. The plate is provided with a clamp 35 in which the valve unit is releasably held in position. The clamp is defined in part by a tab 36 offset angularly from the mounting plate; and by an oppositely disposed angularly offset portion 37 of a clamping plate 38. The clamping plate is separably mounted, as by a bolt 39 to the face of the mounting plate 34. The opposed two tabs 36, 37 diverge angularly from one another to define a V-trough in which the valve unit is seated. Offset extensions 41, 42 of tabs 36 and 37 partially overlie the trough and the valve unit.

In assembling the valve unit to the bracket, the clamp is loosened sufficiently to allow the valve unit to be seated in the V-trough beneath the overhanging tab extensions. Bolt 39 is then tightened, causing the valve unit to become sandwiched in the trough between the several tabs in a rigidly clamped condition.

A collar defined by a cutaway 44 in the edge of the tab extension 41 serves as a rest for the outlet tube 9 of the valve unit; and it also serves to obtain a desired angular disposition of the inlet and outlet tubes for connecting them with their respective hose lines. A hole 40, as in FIG. 6, may be used in lieu of the cutaway 44.

The valve 23 is operable at the election of and under the control of the driver by means of a control cable 45. The latter passes through a conventional supporting flexible cable sleeve 46. The cable is fitted with a pull-knob 47 at one end located in the instrument panel of the vehicle; the other end of the cable is anchored to a valve actuating lever 48. The lever is pivoted intermediately of its ends to the face of the bracket plate 34 upon a pin 49. The upper end of the lever abuts the projecting end of the valve.

By manually actuating the knob 47 the lever will be pivoted to depress the valve to its open position against the resistance of the return spring 27; and when the knob is retracted, spring 27 returns the lever and valve to normal position.

Each nozzle unit 18 includes a straight tubular member or holder 51 having an axially extending bore 52. In the bottom end of the bore there is press fitted a nozzle 53 having a restricted axially extending orifice 54. The holder has an upper portion 55 fitted into one of the branches of the fuel feed line; and it has a lower threaded portion 56 which is screwed through the hole 21 in the intake manifold so as to depend about midway down into the interior of the manifold. A locknut 57 integral with the holder determines and secures the position of the nozzle unit relative to the manifold. In this position of the nozzle unit the axis of the nozzle orifice is perpendicular to the interior bottom wall of the manifold, so that fuel issuing from the nozzle will impinge against the bottom wall and quickly vaporize before entering the nearby intake port of the engine.

The nozzle orifice 54 is such that fuel passed to it from the fuel pump initially jets from the nozzle while the control valve is held open; and, after the valve is closed, the fuel drips gradually at a slow rate from the nozzle. A nozzle orifice of 0.018" and a length of 1/32" have been found to provide good results. The nozzle orifice 54 opens at its rear into wider diameter areas of the nozzle and the holder.

In addition to serving as a holder for the nozzle the portion of the holder depending into the manifold provides an impedance in the path of the fuel-air mixture normally flowing from the carburetor through the intake manifold to the intake port of the engine. This impedance serves to create turbulance in the flowing fuel mixture and, as a consequence causes a more complete and better combustible mixture than would otherwise be obtained.

It is to be noted that a loop 58 is provided in each hose line 17 just before its connection with the related nozzle unit. This loop serves to remain substantially full with fuel at all times, so that when the control valve 23 is opened it is only needed to replenish or fill the short line between the loop and the nozzle 53. This arrangement is desired as it serves to limit the amount of fuel that may be caused to drip into the manifold to the extent of that between the loop and the nozzle, which is ordinarily sufficient to accomplish the purpose intended.

As earlier explained, the system is intended primarily to enable fast starting of a motor vehicle engine when it is cold because of being parked for several hours or overnight in cold weather. Accordingly, before the ignition is turned off to stop the running of the engine the operator will actuate the control valve to open condition and hold it open for a few seconds. This will ordinarily suffice to fill the hose lines with fuel and allow the nozzles to jet some of the fuel into the manifold. Upon the operator next closing the control valve the pressure of the fuel pump on the fuel is relaxed and discontinued causing the fuel to stop jetting. Thereafter, some of the fuel will gradually at a slow rate seep from the nozzles and drip down into the manifold. The slow drip rate and the time lag between each drip enables the fuel to rapidly vaporize. When the driver later turns the ignition key to crank the engine, the vaporized fuel at the intake ports will cause the engine to immediately start running. Further, the fuel-air mixture then being fed normally from the carburetor into the manifold will be subjected to the impedance provided by the nozzle holders. This action will serve to keep the engine running without stalling and to continue thereafter to run better than would otherwise be the case because of the better combustible fuel-air mixture occasioned by the impedance.

While an embodiment of the invention has been illustrated and described in detail, it is to be expressly understood that the invention is not limited thereto. Various changes of form, design or arrangement may be made in its parts without departing from the spirit and scope of the invention. It is my intention, therefore, to claim the invention not only as shown and described but also in all such forms, modifications or equivalents thereof as might be reasonably construed to be within the spirit of the invention when considering the specification, drawing, and the appended claims.

What is claimed is:

1. A system for drip priming a gasoline powered internal combustion engine of a motor vehicle for fast starting of the engine in cold weather, the engine being of a type having piston cylinder intake ports, a fuel pump and an intake manifold provided with outlet ends adjacent the piston cylinder intake ports, the system comprising: a selectively operable fuel feed control valve unit having an inlet and an outlet, the inlet being normally closed to the outlet; drip priming nozzles mounted in the intake manifold having outlet orifices in close proximity to the piston cylinder intake ports, the orifices opening out of the nozzles in opposed spaced relation to a bottom wall of the manifold; the inlet of the valve unit being connected to a discharge port of the fuel pump; a hose having an inlet end connected to the outlet of the valve unit and having multiple branch lines, each branch line being connected to a separate one of the nozzles; the hose and branch lines being adapted to fill with fuel as a consequence of operation of the fuel pump and operation of the valve unit to an open condition, and the nozzles being adapted to effect as a consequence thereof injection of the fuel into the manifold; and a loop formed in each branch line of the hose at a predetermined distance from the connection of the branch line with its related nozzle; and each nozzle being adapted upon the valve unit obtaining a closed condition to cease injection of fuel into the manifold and to thereafter effect dripping of fuel from the related branch line into the manifold to the extent of the fuel filling the related branch line between the related loop and the nozzle.

2. A system as in claim 1, wherein the valve unit has a cylindrical body, and the inlet and outlet are defined by a pair of tubes extending radially from opposite areas of the body, either tube being selectively serviceable as an inlet or outlet port.

3. A gasoline powered internal combustion engine including piston cylinder intake ports, a fuel intake manifold having multiple branches connected with the engine adjacent the piston cylinder intake ports, a fuel pump, a T-fitting having an inlet connected with a discharge end of the fuel pump, and a carburetor having an inlet connected with a first outlet of the T-fitting and having an outlet connected with an inlet to the manifold; characterized by a drip priming fuel feed control valve unit having an inlet tube connected with a second outlet of the T-fitting and having an outlet tube; a separate fuel drip priming nozzle unit depending vertically into each branch of the manifold in close relation to the connection of the branch with the engine; a hose connected with the outlet tube of the valve unit terminating in multiple outlet hose lines, each outlet hose line being connected with a separate nozzle unit; a cylindrical valve element slidable in the valve unit from a normal position closing the inlet tube to the outlet tube to an operated position opening the inlet tube to the outlet tube, the operated position of the valve unit enabling pumping of fuel through the nozzle units into the manifold by the fuel pump upon operation of the latter; a bracket supporting the valve unit; a releasable lever pivoted on the bracket and operable against the valve element to slide it to its open position; spring means cooperable with the valve element to return it to its normal position following a release of the lever; each nozzle unit including a tubular holder fitted in the manifold and a nozzle element having a restricted orifice fitted in a bottom end of the holder; and a loop formed in each of the outlet hose lines in a predetermined spaced relation to the connection of the outlet hose line with its related nozzle unit, the loop controlling subsequent to release of the valve unit to normal closed position dripping of fuel through the related nozzle to the extent of fuel filling the related outlet hose line between the nozzle and the loop.

,21

4. A gasoline powered internal combustion engine as in claim 3, wherein the holder depends into the interior of the manifold to about the mid-point thereof, and a locknut unitary with the holder determines and secures the depending position in the manifold of the holder and the nozzle fitted in the bottom end of the holder.

5. A gasoline powered internal combustion engine as in claim 4, wherein the nozzle has an orifice having a diameter of approximately 0.018 of an inch and a length of approximately 1/32 of an inch.

* * * * *